US005960516A

United States Patent [19]

Zoroufy et al.

[11] Patent Number: 5,960,516

[45] Date of Patent: Oct. 5, 1999

[54] STAIR ROD BRACKET AND STAIR ROD SET

[76] Inventors: Aboolhasan Zoroufy, 3592 Mathias Way, Verona, Wis. 53593; David Hussein Zoroufy, 913 Tramore Trail, Madison, Wis. 53717

[21] Appl. No.: 09/072,375

[22] Filed: May 4, 1998

[51] Int. Cl.[6] ..... A47G 27/06

[52] U.S. Cl. ..... 16/12; 16/10

[58] Field of Search ..... 16/12–15, 10, 16/11; 248/267, 251, 254, 262

[56] References Cited

U.S. PATENT DOCUMENTS

| | | | |
|---|---|---|---|
| 304,951 | 8/1884 | Nobes | 16/12 |
| D. 340,404 | 10/1993 | Prezner . | |
| D. 342,437 | 12/1993 | Prezner . | |
| 391,841 | 10/1888 | Gildemeyer | 16/12 |
| 484,708 | 10/1892 | Gates . | |
| 701,394 | 6/1902 | Richards | 16/12 |
| 737,143 | 8/1903 | Richards | 16/12 |
| 869,492 | 10/1907 | Joyner | 16/12 |
| 1,373,148 | 3/1921 | Phillips . | |
| 1,624,392 | 4/1927 | Cleverly | 16/12 |

FOREIGN PATENT DOCUMENTS 414793 9/1934 United Kingdom .

OTHER PUBLICATIONS

"The Traditional Collection" (also "Victoria Series", "Catherine The Great Series", "Elizabeth Series", "Isabella Series") by Decorative Hardware Studio, Chappaqua, N.Y. (pp. 1–6) (Aug. 1996).

"Zoroufy Stair Rods, Wall Hangers, Runners", by Zoroufy, Madison, WI, covers and pp. 2–11 (1996).

"Zoroufy Stair Rods, Stair–Holds, Wall Hangers", by Zoroufy, Madison, WI, covers and pp. 2–11 (1997).

"Beautiful Brass Stair Rods" by Unique Designs Mfg., Syracuse, N.Y., 2 pages.

"European Elegance", by Buesche, Inc., Irvine, CA, 2 pages.

"Precious Metals Collection" by Zoroufy, Madison, WI, 2 pages.

Renovators, Conway, N.H., No. 116 Summer 1997, cover and p. 43.

"Select Stair Rod Sets" by Zoroufy, Madison, WI, 1 page.

"Zoroufy Stair Rods Solid Brass Collection", by Zoroufy, Madison, WI, 1 page.

*Primary Examiner*—Chuck Y. Mah

*Attorney, Agent, or Firm*—Michael Best & Friedrich LLP

[57] ABSTRACT

A stair rod set having a pair of finials, a stair carpet retaining rod, and a pair of slidably interconnecting stair rod brackets. The slidably interconnecting stair rod brackets each have a top portion and a bottom portion. Each bracket has travel stop therein to stop the lateral travel of the top portion of the bracket with respect to the bottom portion of the bracket, as well as, to stop the lateral travel of the stair carpet retaining rod. The finials each have a male fastening portion for fastening the bracket through the travel stop to the rod. A stair rod bracket kit having a bracket as previously described, where the bracket has a plurality of top portions for use with a single bottom portion is included. The top portions of the bracket in the stair rod bracket kit differ in the presence or absence of indicia on them, or by the presence of differing indicia on them. A stair rod kit having a pair of finials, a stair carpet retaining rod, and a pair of slidably interconnecting stair rod brackets with interchangeable top portions, as described for the stair rod bracket kit is included.

14 Claims, 6 Drawing Sheets

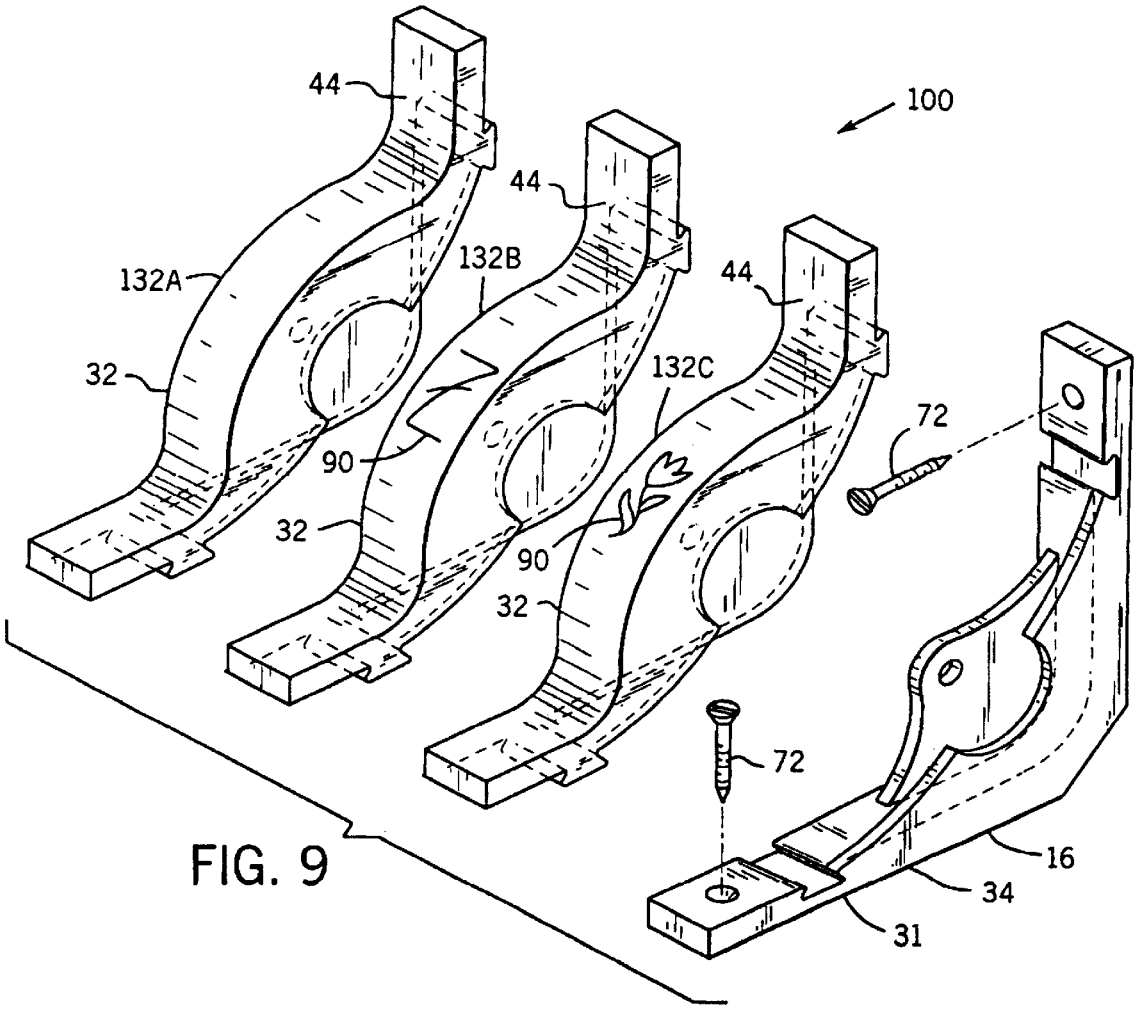
FIG. 9
FIG. 11
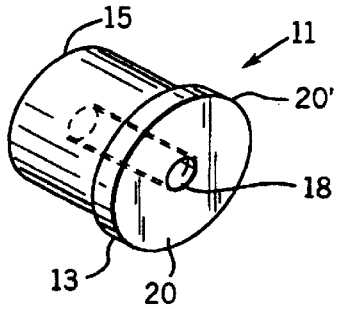

STAIR ROD BRACKET AND STAIR ROD SET

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to stair rod brackets and to stair rod sets and in particular, to slidably interconnecting stair rod brackets and stair rod sets having a pair of slidably interconnecting stair rod brackets, a stair carpet retaining rod and a pair of finials. The invention also includes stair rod bracket kits and stair rod kits using the interconnecting stair rod bracket. The stair rod set is especially useful for releasibly fastening carpet runners to a staircase.

Carpet runners or other floor coverings are releasibly affixed to stairs using stair rod sets. Many stair rod sets sold today are used as a decorative accent to the stairs and carpet runners. The stair rod set serves a decorative function as well as a useful function in preventing slippage of the carpet runner on the stairs of a staircase. A staircase typically has a plurality of steps. Each step has a riser and a tread. The stair rod set typically includes a pair of brackets with each bracket fastened to the step of a staircase. The brackets are spaced from the edges of the carpet runner and fastened at opposite sides of the step. Stair brackets frequently have a top portion and a bottom portion. Often, the bottom portion is fastened to the riser and the tread of the step of the staircase. A rod extends over the carpet runner and is held between and by the pair of brackets. A pair of finials may be used in conjunction with the stair rod and pair of brackets with one finial attached to each bracket. In some devices, the stair rod extends through the bracket (see U.S. Pat. No. 484,708 to Gates; U.S. Pat. No. 1,373,148 to St. John Phillips; U.S. Pat. No. Des. 343,437 to Prezner); in these instances, the bracket is often referred to as a "stair eye" or "open eye-type bracket" because the bracket has a hole or eye therethrough for accepting the stair rod. The use of a "stair eye" type bracket poses special problems. Should a person, pet or object accidently get entangled in the rod, the stair rod may slip laterally (transversely/longitudinally) and slide out through the eye of the bracket. This poses a particular danger in certain types of staircases, which are designed as open staircases on one, or both sides. Open staircases are frequently used for their ornamental beauty in clubs, restaurants, hotels, as well as in private homes and apartments. Slippage of the rod could result in the rod falling on persons, pets or objects under and adjacent the open side(s) of the staircase.

Prior art attempts have responded to some of the problems of lateral slippage of the stair rod through eye of the bracket by the use of a finial at the end of the stair rod. For example, the largest outer diameter of the finial is dimensioned to exceed the diameter of the opening of the bracket eye. Often the finial is not fastened to the rod but is designed with a finial cap to engage about an end of the rod.

Other attempts to solve the problem of the slippage of the stair rod in a stair eye bracket type, have utilized a lug to engage the end of the rod (See e.g., GB patent 414,793).

Yet other attempts to address the problem of slippage have resulted in stair brackets having a end wall. The end wall design prevents penetration therethrough by the stair rod. Often for decorative purposes, a female finial is fastened to the end wall of the bracket using a threaded fastener. The term female finial means herein throughout, a finial having an aperture therein for accepting a fastener. An example of a female finial is shown in U.S. Pat. No. Des. 340,404 to Prezner, wherein a screw is threaded through the end wall and into the finial prior to the insertion of the stair rod into the bracket. Use of the stair bracket having an end wall, however, introduces problems associated with ease in opening and closing the brackets for removal of the stair rod in order to remove the carpet for cleaning, and for cleaning and polishing the stair rod, brackets and finials.

Special problems related to easily removing the stair rod from the bracket are associated with both the end wall type bracket and with the open eye-type bracket. Attempts have been made to resolve these problems with the design of brackets having top portions which are pivotally slidable (e.g., "THE TRADITION COLLECTION" by Decorative Hardware Studio, Chappaqua, N.Y.) or hingeably upliftable (U.S. Pat. No. Des. 342,437; also, see the "VICTORIA SERIES", "CATHERINE THE GREAT SERIES", "ELIZABETH SERIES", and "ISABELLA SERIES" by Decorative Hardware Studio, Chappaqua, N.Y.), or moveably upliftable (U.S. Pat. No. 1,373,148 to St. John Phillips) or traversely slidable or engageable (U.S. Pat. No. 484,708 to Gates and GB Patent 414,793). The use of brackets having hingeably upliftable, pivotally slidable or moveably upliftable top portions have required the use of fasteners or projections which make the bracket harder to use and more expensive to fabricate. Also the upliftable, pivoting or moveable portions may be subject to breaking off or loosening after extended use. In addition, cleaning and polishing these types of brackets is more difficult because they have more parts and recesses that require cleaning. Further, the messy job of cleaning and polishing the top portion of the bracket frequently must be done on the staircase, unless both the top portion and the bottom portion of the bracket are removed.

Another problem with stair eye brackets which are traversely engagable is that accidentally jarring the top portion of the bracket can cause transverse overtravel, e.g., the top portion of the bracket disengages from the bottom portion of the bracket, thus bending the bracket portions and/or the stair rod, or causing the stair rod to fall out of the bracket. Attempts to solve this problem using springs and plungers are known (See, e.g., GB Patent 414,793). However, the use of springs and plungers adds to the complexity of using the bracket and the costs of making the bracket.

Still a further problem occurs when a person accidentally steps on the rod. The application of pressure to the rod frequently causing bowing of the rod. In some instances, the bowing of the rod causes the rod to come out of the brackets. This, of course, may pose a safety problem, since, in addition, to the possibility of the lateral slippage, there is the possibility that the person may slip on the rod while walking up the steps.

Another problem exists when it is desired to change the decorative look of the stair rod set. This can be expensive and time consuming. This change frequently requires the purchase of new pairs of brackets, which require installation and possible refinishing of the holes in the steps made by the fasteners which held the old brackets in place on the staircase.

Thus, notwithstanding the many known practical design problems for stair rod brackets and stair rod sets, the art has not adequately responded to date with the introduction of transversely slidable stair bracket having an end wall which is not penetrated by the stair rod and, also, which bracket has a travel stop therein to prevent both the transverse lateral travel of the stair rod itself and the transverse overtravel of the top portion and bottom portion of the stair bracket. Nor has the art responded with a stair rod set having a pair of the aforementioned brackets, a pair of finials and a stair carpet retaining rod, where the stair carpet retaining rod has an aperture at each end for fastening a finial, where each finial has a male fastening portion which fastens the end wall of the bracket, the travel stop of the bracket and the stair carpet retaining rod together, thus ensuring that the stair carpet retaining rod is held securely in place, and prevented from bowing or coming out of the brackets when pressure is applied to the stair carpet retaining rod. Nor has the art responded with an economical, easy to use stair rod bracket having easily interchangeable top portions which easily fit into a bottom portion, where the top portions have a front face with design indicia thereon, or alternatively, no design indicia thereon, thereby allowing a user/customer to easily change the decorative look of the stair rod bracket or stair rod set as the user/customer desires.

BRIEF SUMMARY OF THE INVENTION

The present invention provides a stair rod bracket and a stair rod set. The stair rod bracket is slidably interconnecting for easy assembly and disassembly. The stair rod set has a pair of slidable interconnecting stair rod brackets, a stair carpet retaining rod and a pair of finials. The stair rod set is advantageously useful for releasibly fastening a carpet runner to a staircase. The invention also provides a stair rod bracket kit and a stair rod set kit having the slidable interconnecting stair rod brackets.

The foregoing, and other advantages of the present invention, are realized in one aspect thereof, in a transversely interconnecting slidable stair rod bracket for use in a stair rod set having a stair carpet retaining rod and a finial with a male fastening member thereon. The bracket comprises a top portion having a rod-receiving portion and having an end wall with an aperture therein for accepting the male fastening portion of the finial, a bottom portion having a rod-receiving portion, a plurality of projections and complementary shaped channels for receiving the projections disposed on the top portion and the bottom portion for transverse engagement of the top portion with the bottom portion, and a travel stop for stopping the lateral travel of the top portion with respect to the bottom portion and for stopping lateral travel of the carpet retaining rod. The plurality of projections are disposed on the top portion of the bracket and the complementary channels are disposed on the bottom portion of the bracket. The plurality of projections are dove-tailed projections and the plurality of channels are correspondingly shaped dove-tailed channels. The travel stop is a plate extending from the bottom portion, and spaced from the rod-receiving portion of the bottom portion of the bracket. The travel stop has an aperture therein dimensioned to accept the male fastening portion of the finial. The travel stop is dimensioned to pass through the rod-receiving portion of the top portion of the bracket when the top portion of the bracket is transversely engaged with the bottom portion of the bracket.

In another aspect, the present invention includes a stair rod set comprising: a stair carpet retaining rod, a pair of finials, each finial having a male fastening portion; and a pair of stair brackets. Each bracket having a top portion, a bottom portion, a plurality of projections and complementary shaped channels for receiving the projections disposed on the top portion and the bottom portion for transverse engagement of the top portion with the bottom portion, and a travel stop for stopping the lateral travel of the top portion with respect to the bottom portion and for stopping lateral travel of the rod; wherein each of the top portions and bottom portions has rod-receiving portions dimensioned to accept a portion of the rod, and wherein each top portion has an end wall having an aperture therein for accepting the male fastening portion of one of the finials. The plurality of projections are disposed on the top portion and the complementary channels are disposed on the bottom portion of the bracket. The plurality of projections are dove-tailed projections and the plurality of channels are correspondingly shaped dove-tailed channels. The travel stop is a plate extending from the bottom portion, and spaced from the rod-receiving portion of the bottom portion of the bracket. The travel stop has an aperture therein dimensioned to accept the male fastening portion of the finial. The travel stop is dimensioned to pass through the rod-receiving portion of the top portion of the bracket when the top portion of the bracket is transversely engaged with the bottom portion of the bracket.

A further aspect of the present invention includes a stair rod bracket kit for use in a stair rod set having a stair carpet retaining rod and a finial with a male fastening portion thereon. The stair rod bracket kit comprises:

a) a plurality of top portions of a bracket, each of the top portions having a face and two end walls extending from the face, one of the end walls having an aperture therein for accepting the male fastening portion of the finial, the other end wall having a rod-receiving portion for accepting a portion of the rod;

(b) a single bottom portion of a bracket for use with any one of the plurality of top portions, the bottom portion having a base with an end wall having rod-receiving portion, for accepting a portion of the rod, extending from the base and an interior plate extending from the base, the end wall spaced from the interior plate, the interior plate stopping the lateral travel of the top portion with respect to the bottom portion and for stopping lateral travel of the rod; and (c) a plurality of projections and complementary shaped channels for receiving the projections disposed on the top portion and the bottom portion for transverse engagement of the top portion with the bottom portion;

wherein the plurality of top portions differ from one another in the absence or presence of indicia applied to the face or in the presence of differing indicia applied to the face. The plurality of projections are disposed on the top portion and the complementary channels are disposed on the bottom portion of the bracket. The plurality of projections are dove-tailed projections and the plurality of channels are correspondingly shaped dove-tailed channels.

In yet another aspect, the present invention includes a stair rod set kit comprising:

(a) a stair carpet retaining rod;

(b) a pair of finials, each finial having a male fastening portion: and (c) a pair of stair brackets, each bracket of the pair of brackets having (i) a plurality of top portions, each of the top portions having a face and two end walls extending from the face, one of the end walls having an aperture therein for accepting the male fastening portion of the finial, the other end wall having a rod-receiving portion for accepting a portion of the rod;

(ii) a single bottom portion for use with any one of the plurality of top portions, the bottom portion having a base with an end wall having rod-receiving portion, for accepting a portion of the rod, extending from the base and an interior plate extending from the base, the end wall spaced from the interior plate the interior plate stopping the lateral travel of the top portion with respect to the bottom portion, and for stopping lateral travel of the rod; and (iii) a plurality of projections and complementary shaped channels for receiving the projections disposed on the top portion and the bottom portion, for transverse engagement of the top portion with the bottom portion;

wherein the plurality of top portions differ from one another in the absence or presence of indicia applied to the face or in the presence of differing indicia applied to the face. The plurality of projections are disposed on the top portion and the complementary channels are disposed on the bottom portion of the bracket. The plurality of projections are dove-tailed projections and the plurality of channels are correspondingly shaped dove-tailed channels.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which:

FIG. 9 is a view of a stair rod bracket kit of the present invention having a plurality of interchangeable stair rod bracket top portions and a stair rod bracket bottom portion and optional fasteners;

Figure 10:
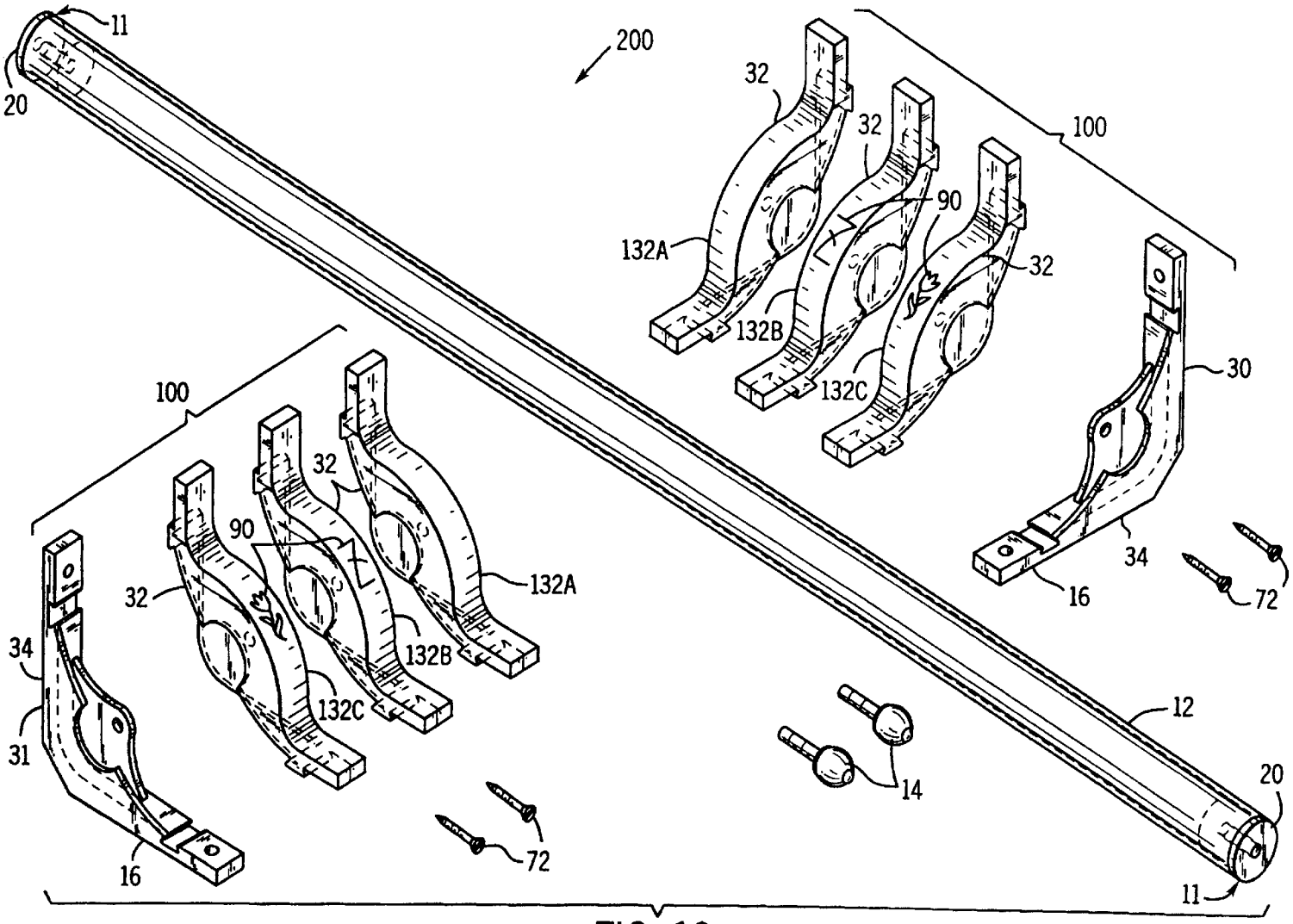

FIG. 10 is a stair rod set kit having a plurality of interchangeable left side stair rod bracket top portions, a left side stair rod bracket bottom portion, a plurality of interchangeable right side stair rod bracket top portions, a right side stair rod bracket bottom portion, a stair carpet retaining rod, a pair of finials and optional fasteners; and FIG. 11 is a perspective view of the rod cap for use in the hollow core type stair carpet retaining rods.

DETAILED DESCRIPTION OF THE INVENTION

The present invention relates broadly to a stair rod bracket. Specifically, the invention provides a stair rod bracket, a stair rod set, having a pair of slidably interconnecting stair rod brackets, a stair carpet retaining rod and a pair of finials, a stair rod bracket kit, and a stair rod set kit. The stair rod set is especially useful for releasibly fastening carpet runners to a staircase. Accordingly, the present invention will now be described in detail with respect to such endeavors; however, those skilled in the art will appreciate that such a description of the invention is meant to be exemplary only and should not be viewed as limitative on the full scope thereof.

Figure 1:
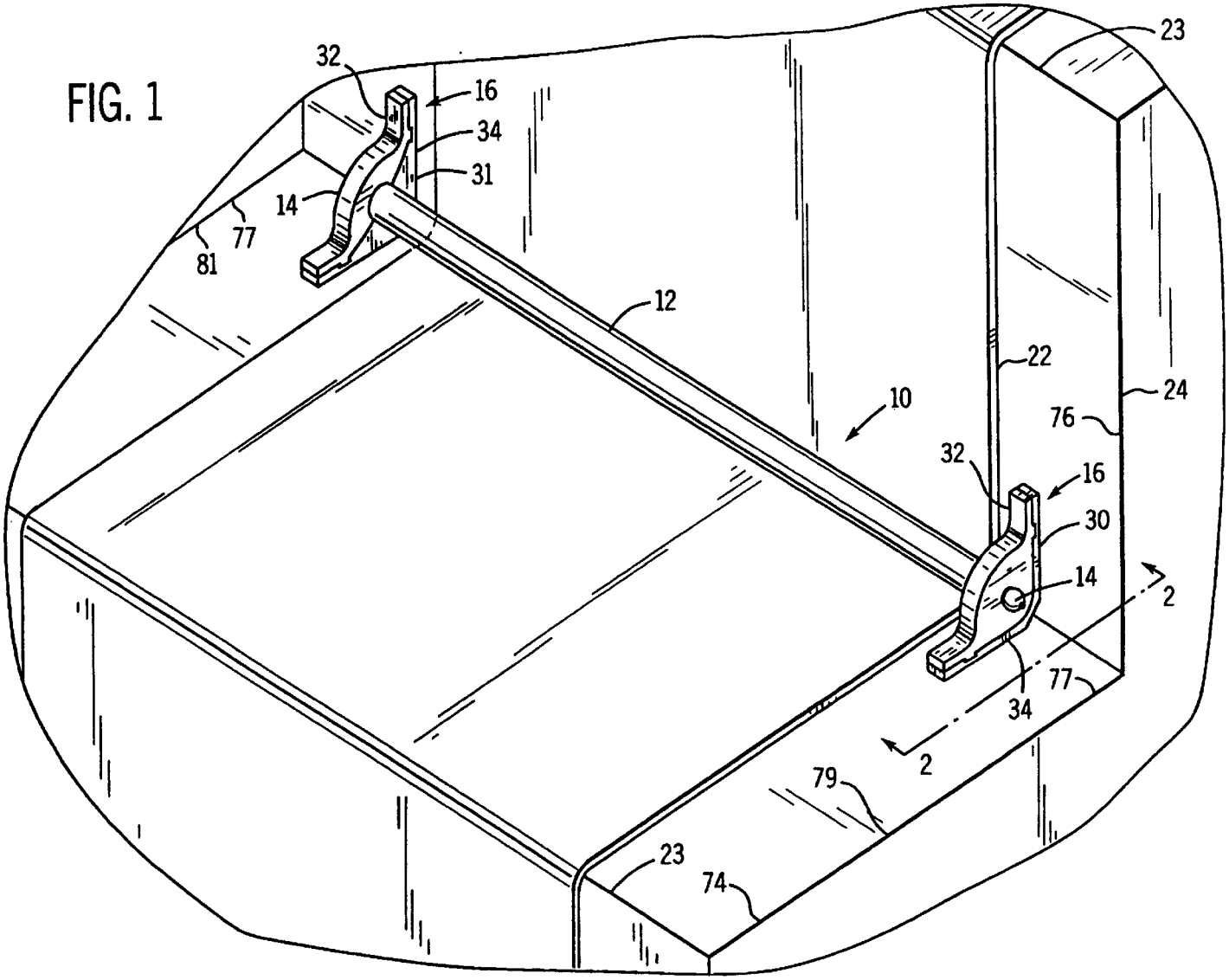
FIG. 1 is a perspective view of the stair rod set of the present invention.

Reference is initially made to FIG. 1 depicting a stair rod set, specifically, a stair rod set 10 having a stair carpet retaining rod 12, a pair of finials 14, and a pair of slidably interconnecting stair rod brackets 16, according to the present invention. The rod 12, the finials 14 and the brackets 16 are preferably made of metals, such as, but not limited to, brass, bronze, copper, aluminum, iron or steel or alloys thereof, and is most preferably made of brass. The brackets 16 may be cast, molded or carved from a single mass of metal, most preferably brass.

Stair carpeting retaining rods are known and are elongate in shape with opposed ends. These rods have either a hollow core (often referred to as a hollow core-type rod) or a solid core (often referred to as a solid core-type rod). Stair carpeting retaining rods are also known to come in various cross sectional shapes, such as circular, triangular, square, etc.

The rod 12 is of a length sufficient to extend beyond a width of a carpet runner 22 which is to be releasibly affixed to a step 23 of a staircase 24. The stair carpet retaining rod 12 is an elongate member having opposing ends 20, with an aperture 18 at each opposing end 20. Aperture 18 is suitably dimensioned to accept a fastening means extending from the finial 14. The rods 12 are either of a solid core type having a solid metal cross section (i.e., a solid core 19) or of a hollow core type having a hollow core 17 surrounded by a rod wall 21 having a hollow rod wall end 21'. As shown in FIG. 6 for solid core-type rods, the aperture 18 is suitably bored or drilled into the solid core 19 of the rod 12 at an end 20. As shown in FIGS. 4–5, 7–8 and 11 for hollow core-type rods, the aperture 18 is drilled into a cap 11 which is fitted into the hollow core 17 at the hollow rod wall end 21' of the hollow core-type rod 12. Preferably the stair rod 12 is of the solid core-type and is an elongate solid cylindrical metal member having apertures 18 bored into the rod 12 at each of its opposed ends 20. Most preferably, the stair rod 12 is of the hollow core-type and is an elongate cylindrical hollow metal rod having a pair of caps 11 with one cap 11 disposed at each end 20.

Figure 7:
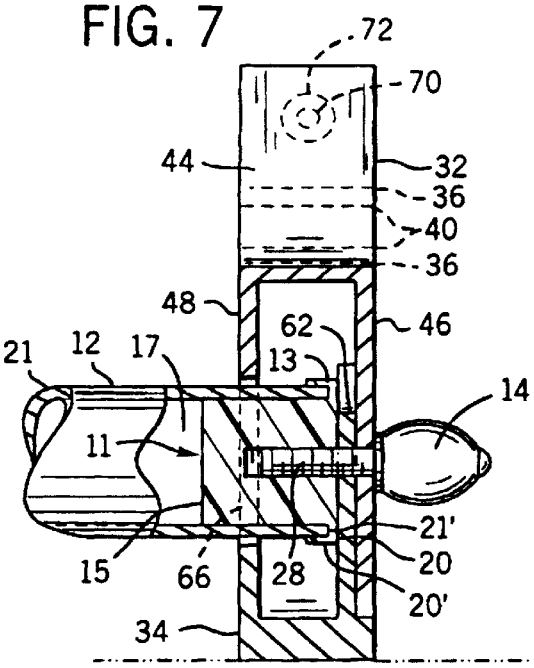
FIG. 7 is a cross section, taken along section line 7—7 of FIG. 3, of the bracket of FIG. 2, as mounted in FIG. 1; the left side stair bracket being a mirror image thereof.

As best shown in FIGS. 7 and 11, the cap 11 has an outer lip 13 and a plug portion 15. The outer lip 13 is dimensioned to fit over the rod wall end 21' of the rod 12, extending snugly around a circumference of the rod wall end 21'. The plug portion 15 is dimensioned to fit snugly within the hollow core 17 of the rod 12. The plug portion 15 has the aperture 18 bored or drilled therein for accepting the fastening means extending from the finial 14. The cap 11 is made of rigid materials which can be drilled. Such materials include, but are not limited to, a plastic material, such as a PVC (polyvinyl chloride) or a nylon material or an acrylic material. The outer lip 13 of the cap 11 advantageously prevents the noise caused by rubbing of metal parts on metal parts should the carpet runner 22 loosen or slip. When the cap 11 is installed on the hollow core 17 of the rod, the rod end 20 is a capped end 20'. In either type of rod 12, solid core type or hollow core type, the end of the rod 20 refers to the most distal part (end) of the rod 12. In the hollow core-type rod, the most distal part of the rod 12 is the capped end 20'.

As best shown in FIGS. 4–8, each of the identically dimensioned finials 14 of the present invention has a main portion 26 and a male fastening portion 28 extending from the main portion 26. The male fastening portion 28 of the finial 14 is of a length sufficient to be inserted into the bracket 16 and to engage in the aperture 18 in the end 20 of the rod 12, thereby fastening the bracket 16 to the rod 12. The male fastener 28 is suitably a thread screw fastener.

As best shown in FIG. 1, the pair of slidably interconnecting stair rod brackets 16 are disposed with one bracket 16 of the pair fastened at each end 20 of the rod 12, when the stair rod set 10 is assembled. The pair of brackets 16 are a right side stair bracket 30 and a left side stair bracket 31. The brackets 30, 31 are constructed as mirror images of each other. By the term "mirror image" is meant herein throughout that the parts of the brackets 30, 31 are arranged with the reversal of right and left as would appear if seen in a mirror. Hence, although the right side stair bracket 30 is described in detail, it is understood by those skilled in the art that the corresponding identically numbered parts in the left side stair bracket 31 are present in mirror image spacial orientation and are encompassed by the present invention.

As best shown in FIGS. 2–8, which figures will be explained in more detail later, the bracket 16 of the present invention includes a top portion 32 and a bottom portion 34. The top portion 32 and the bottom portion 34 of each bracket 16 slidably interconnect permitting transverse (lateral) engagement of the top portion 32 with the bottom portion 34. Each bracket 16 has a plurality of projections which engage in a mating fashion in corresponding complementary shaped channels. Most preferably, each bracket 16 has projections 36, 38 on the top portion 32 which engage in a mating fashion in correspondingly shaped complementary channels 40, 42, respectively, in the bottom portion 34 of the bracket 16 when the top portion 32 is slid in a transverse (longitudinal/lateral) manner into the bottom portion 34 of the bracket 16. Most preferably, the projections 36, 38 and channels 40, 42 are in the nature of dove-tail-type joints. Alternatively, the projections are suitably disposed on the bottom portion 34 and the channels on the top portion 32 of the bracket 16. Yet alternatively, the bottom portion 34 suitably has a first single projection and a first single channel, and the top portion 32 suitably has a corresponding complementary shaped channel to engagingly mate with the first single projection and has a corresponding complementary shaped projection to engagingly mate with the first single channel. Although two projections 36, 35 with their corresponding channels 40, 42 are shown, more projections and associated corresponding complementary shaped channels may be used. Other types of combinations of projections and corresponding complementary shaped channels can be envisioned by those of ordinary skill in the art and are encompassed by the present invention.

The top portion 32 of the bracket 16 includes a front face 44 and two end walls. The first end wall is an outside end wall 46 extending downwardly from the front face 44. The second end wall is an inside end wall 48 extending downwardly from the top face 44. Outside end wall 46 has an outside end wall edge 50, an inside surface 51 and a outside end wall thickness 53. Inside end wall 48 has an inside end wall edge 52 having a wall thickness 55, and a stair rod-receiving portion 56. Inside end wall 48 is spaced from and generally parallel to the outside end wall 46. Outside end wall 46 has an aperture 54 therethrough, suitably dimensioned to permit passage of the male fastening portion 28 of the finial 14.

The bottom portion 34 of the bracket 16 includes a base portion 58 having an inside end wall 60 extending upwardly therefrom, a travel stop 62, and a base edge 63. The travel stop 62 is an interior plate which extends upwardly from the base portion 58. The inside end wall 60 has an inside end wall edge 64 and a stair rod-receiving portion 66. The travel stop 62 is spaced from the stair rod-receiving portion 66. The base 58 of the bottom portion 34 of the bracket 16 has a pair of apertures 68, 70 therethrough for accepting fasteners 72 to fasten the bottom portion 34 of the bracket 16 to a stair tread 74 and stair riser 76 of the step 23 of the staircase 24. When the bracket 16 is assembled, the outside end wall edge 50 and the base edge 63 are disposed facing an end 77 of the step 23.

The travel stop 62 advantageously limits (stops) the lateral travel of the top portion 32 with respect to the bottom portion 34 of the bracket 16 as well as limits (stops) the lateral travel of the stair bracket retaining rod 12. The travel stop 62 most advantageously prevents transverse (longitudinal, side-to-side) sliding of the rod 12 within the bracket 16 and, also, at the same time prevents transverse overtravel, e.g., slippage of the top portion 32 of the bracket 16 relative to the bottom portion 34 of the bracket 16 when the finial 14 is fastened into the bracket 16 and rod 12, and further provides added strength for fastening the rod 12 when the top portion 32 and the bottom portion 34 are interconnected. This single member, the travel stop 62, performs multiple functions, thus making the bracket 16 more efficient to use and less costly to manufacture. The travel stop 62 is spaced from the inside side end wall 60 and disposed generally parallel to it. The travel stop 62 is suitably dimensioned to prevent the rod 12 from traveling through the bracket 16. Thus rod 12 cannot engage against surface 51 of the top portion 32 of the bracket 16. Advantageously the travel stop 62 limits the lateral travel of the stair bracket retaining rod 12. Also the travel stop 62 is spaced from the base edge 63 by the outside end wall thickness 53. This spacing permits the outside end wall 46 to abut against the travel stop 62, preventing transverse overtravel. Travel stop 62 has an aperture 78 therethrough, suitably dimensioned for receiving the male fastening portion 28 of finial 14. Aperture 78 is aligned with aperture 54 in the outside end wall 46 and with aperture 18 in the end 20 of the rod 12. Travel stop 62 is suitably dimensioned to pass under the inside end wall edge 52 and to pass through the stair receiving rod portion 56 of the top portion 32 of the bracket 16 when the top portion 32 is slid over the bottom portion 34 and the bracket 16 assembled. The travel stop 62 has a portion 80 through which aperture 78 penetrates. Preferably, when the rod 12 is of a cylindrical shape, portion 80 is curved, having a radius of curvature smaller than a radius of curvature of the rod 12. Portion 80 adds to the strength of the bracket 16.

Figure 2:
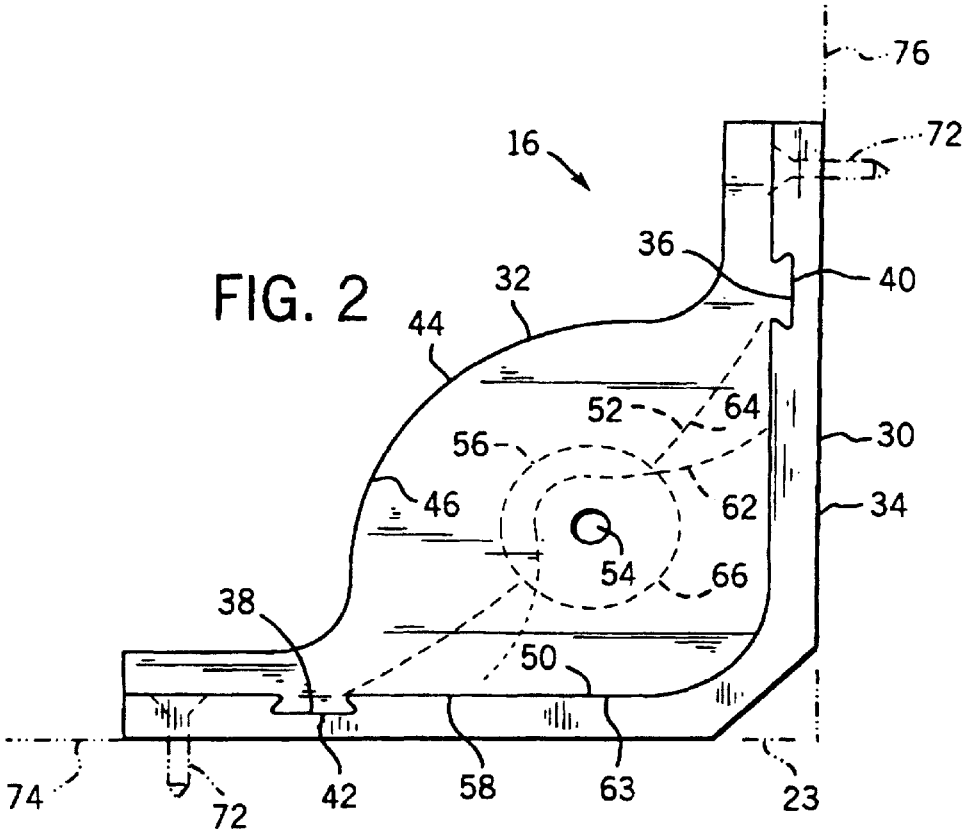
FIG. 2 is a side view, as viewed from view line 2—2 of FIG. 1, of the right stair bracket of the present invention showing the end wall; the left side stair bracket being a mirror image thereof.
Figure 3:
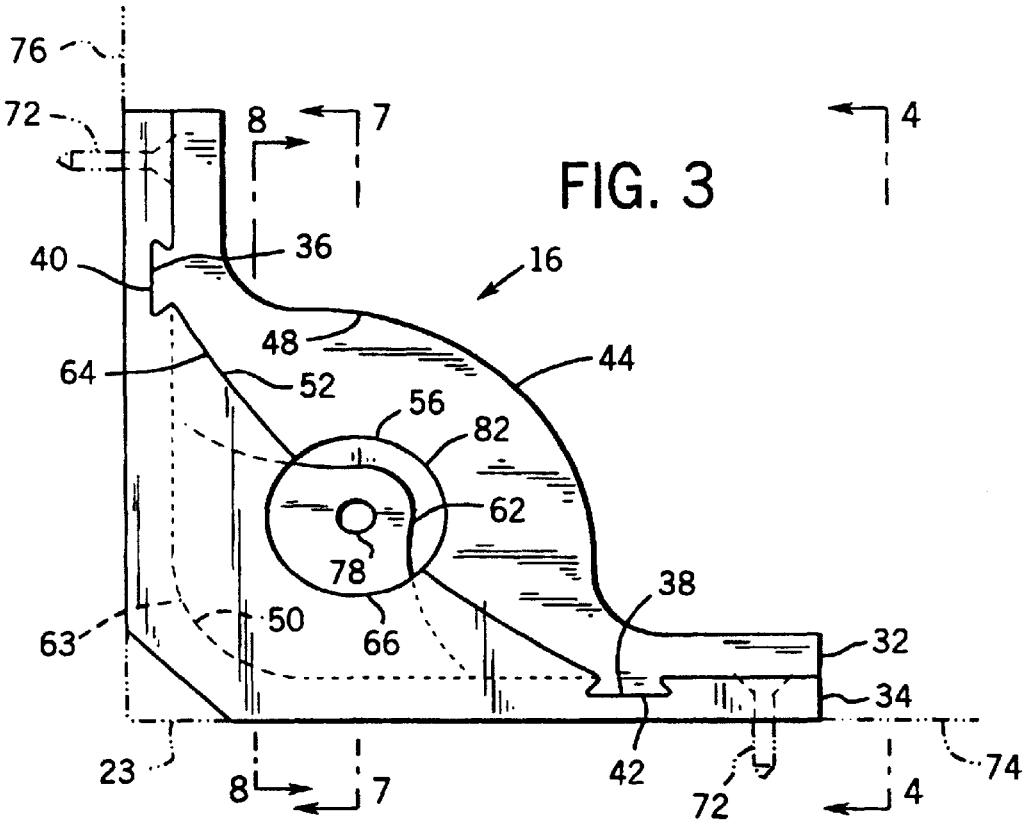
FIG. 3 is the opposite side view of the right stair bracket of FIG. 2; the left side stair bracket being a mirror image thereof.

As best shown in FIGS. 1–3, for each bracket 16, the outside end wall edge 50 of the top portion 32 and the base edge 63 of the bottom portion 34 are complementary in shape, such that these edges 50, 63 abut against each other when the top portion 32 of the bracket 16 is slid into the bottom portion 34 of the bracket 16. Thus, the edges 50 and 63 engage in a mating fashion. Likewise, the inside end wall edge 52 of the top portion 32 of the bracket 16 and the inside end wall edge 64 of the bottom portion 34 of the bracket 16 are complementary in shape, such that the edges 52, 64 abut against each other (except for the stair rod receiving portions 56, 66) when the top portion 32 of the bracket 16 is slid into the bottom portion 34 of the bracket 16. Thus, the edges 64 and 52 engage in a mating fashion, except for the stair rod receiving portions 56, 66. The stair rod receiving portions 56, 66 when combined create an aperture 82 which is sufficiently dimensioned to hold the rod 12 within the bracket 16. The transverse (lateral) travel of the rod 12 between the pair of brackets 16 (left side stair bracket 31 and right side stair bracket 30) is limited by each travel stop 62. In each bracket 16, an end 20 of the rod 12 abuts against the portion 80 of the travel stop 62. Likewise, the transverse travel of the top portion 32 of the bracket 16 with respect to the bottom portion 34 of the bracket 16 is limited by the travel stop 62. Inside surface 51 of the outside end wall 46 of the top portion 32 of the bracket 16 abuts directly against travel stop 62 thereby limiting side-to-side transverse travel. The rod aperture 18, the travel stop aperture 78 and the outside end wall aperture 54 are aligned and similarly dimensioned to accept the male fastening portion 28 of the finial 14. The insertion of the male fastening portion 28 of the finial 14 through the travel stop 62 and the outside end wall 46 holds the top portion 32 and the bottom portion 34 of the bracket 16 together better than prior art brackets because the force exerted on each bracket 16 from the rod 12 and the finial 14 is in all directions, (x, y, z axis) and this better prevents movement in the horizontal direction. This is best shown in FIGS. 4–8.

The abutting relationships of the pairs of edges 50, 63 and 52, 64 along with the abutting relationship of the travel stop 62 with the inside surface 51 of the outside end wall 46, and the alignment of respective apertures 54, 78 in the outside end wall 46 and the travel stop 62, create a uni-body bracket construction that is unique to any prior art stair rod bracket and to any prior art stair rod set. The uni-body construction achieves the most sturdy construction of any previous stair rod set. The sturdiness creates a more secure installation of the stair carpet retaining rod 12, and hence, a safer installation of the stair rod set 10.

The structure of the pairs or abutting edges 50, 63 and 52, 64 and the structure of the mating engageable projections and complementary channels produce a bracket 16 which is very easy to assemble and disassemble. This is important because the structure of the bracket 16 permits the easy assembly/disassembly of the stair rod set 10, the easy removal of the top portion 32 of the bracket 16 for cleaning and polishing and the easy replacement of the top portion 32 of the bracket 16. No longer must the user/customer, carry solvents and polishing tools to the staircase to clean the top portions 32 of the bracket 16. The top portions 32 of the brackets 16 are easily removed from the bottom portion 34 of the brackets 16 (after the finials 14 have been loosened and removed) by sliding the top portion 32 in a transverse lateral direction opposite that used to install them. The bracket top portion 32 may then be collected and carried to a more convenient location than the staircase 24, to clean and polish them.

The FIGS. 2–8 are presently explained in more detail. FIG. 2 is a side view of the right side stair bracket 30 of the present invention showing the end wall 46, the outside end wall edge 50, the base portion 58 and the base edge 63; the left side stair bracket 31 is a mirror image thereof. The hidden lines show the placement of the fasteners 72 fastening the bottom portion 34 of the bracket 16 to the tread 74 and riser 76 of a step 23 of a staircase 24. The hidden lines also show the location of the travel stop 62, the inside end wall edge 52, including the rod-receiving portion 56 of the top portion 32 of the bracket 16, and the inside wall edge 64 and the rod-receiving portion 66 of the bottom portion 34 of the bracket 16.

FIG. 3 is the opposite side view of the right side stair bracket 30 of FIG. 2; the left side stair bracket 31 is a mirror image thereof. The hidden lines show the placement of fasteners 72 in the tread 74 and riser 76 of the step 23 of the staircase 24. The hidden lines also show the location of outside end wall edge 50 and base edge 63, as well as hidden portions of the travel stop 62.

Figure 4:
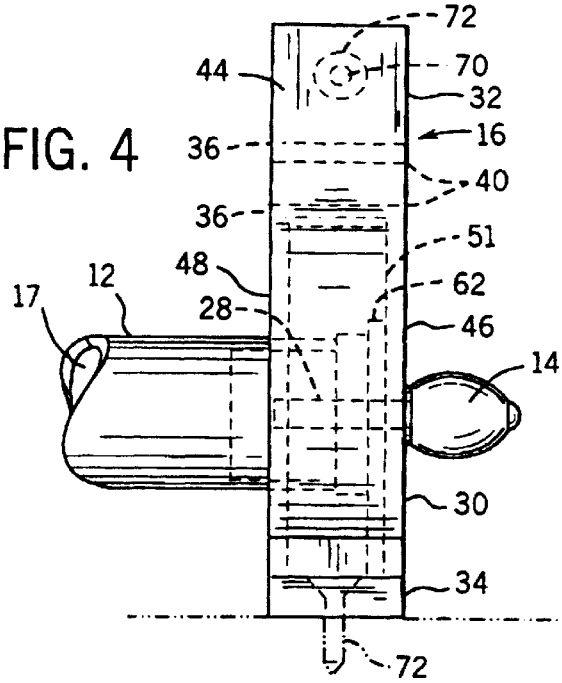
FIG. 4 is a front view of the stair bracket of FIG. 2, showing the stair rod engaged therein and with the finial fastening the bracket to the stair rod, as shown in FIG. 1; the stair rod engagement with the finial fastening the left side stair bracket and the left side stair bracket being a mirror image thereof.

FIG. 4 is a top view of the stair bracket of FIG. 2, showing one end 20 of the rod 12 engaged therein and with the finial 14 fastening the bracket 30 to the stair rod 12, as shown in FIG. 1. The rod 12 is shown in partial length. The rod 12 engagement with the finial 14 fastening the left side stair bracket 31 and the right side stair bracket 30 are a mirror image thereof. The hidden lines show the fasteners 72, edges of the projection 36 and channel 40, the outside end wall 46, the travel stop 62, the end 20 of the rod 12, the inside surface 51 of outside end wall 46, an edge of the inside end wall 48 and the male fastening portion 28 of the finial 14.

Figure 5:
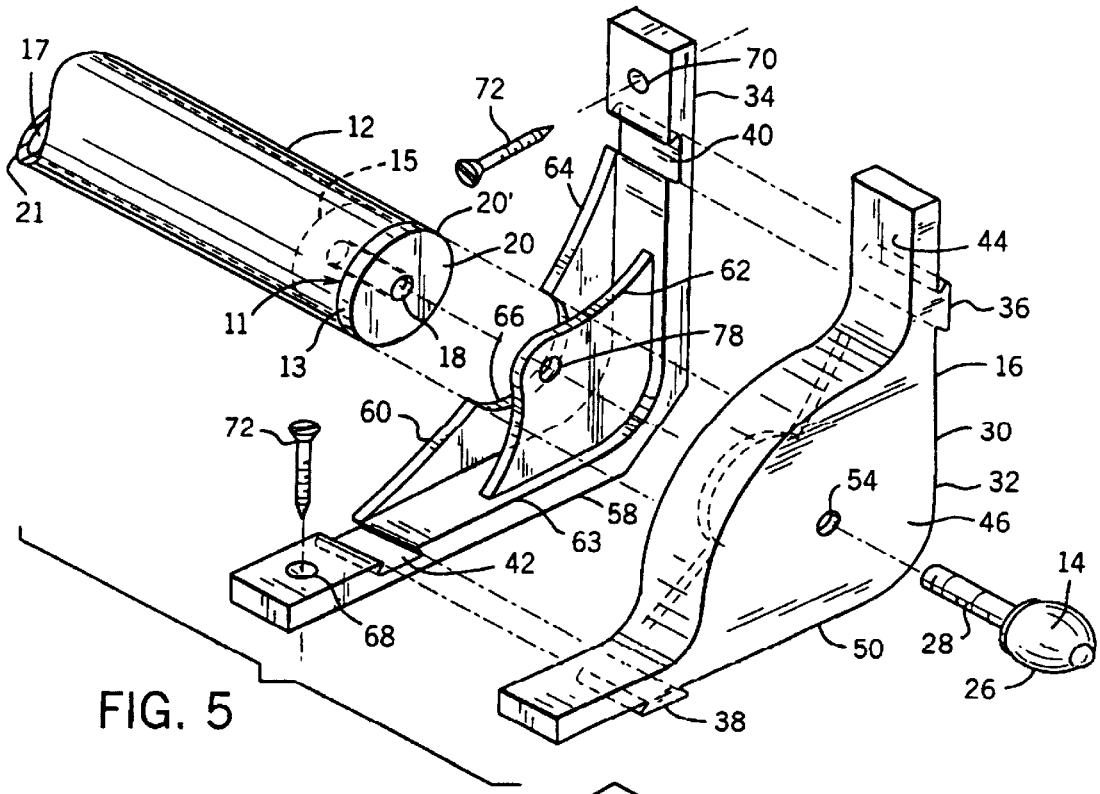
FIG. 5 is an exploded view of the right stair bracket; the left side stair bracket being a mirror image thereof.
Figure 6:
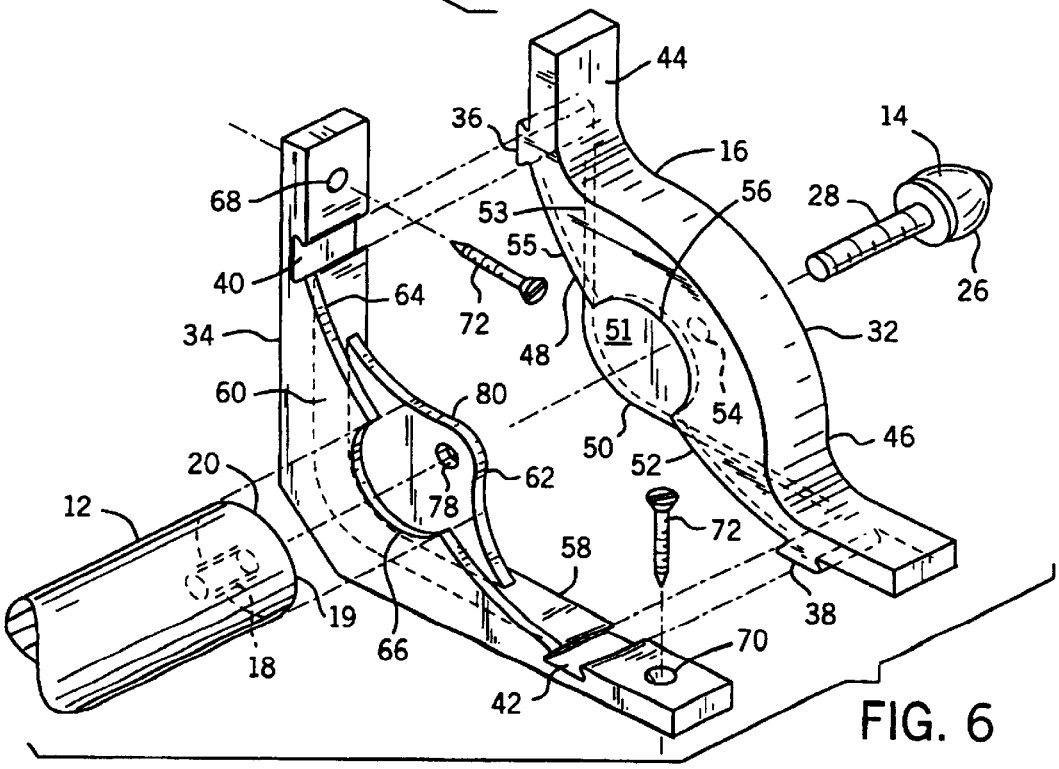
FIG. 6 is an another exploded view of the right stair bracket; the left side stair bracket being a mirror image thereof.

FIG. 5 is an exploded view of the right side stair bracket 30, the finial 14 and the end portion 20 of the rod 12; the left side stair bracket 31, finial 14, and portion 20 of the rod 12 is a mirror image thereof. The hidden lines in the top portion 32 of the bracket 16 show the structure of the projections 36, 38, the inside end wall edge 52 and the wall thickness 55. The hidden lines in the rod 12 show the rod wall 21. The hidden lines in the bottom portion 34 of the bracket 16, show the channels 40, 42, and the structure of inside end wall 60. The rod 12 is shown in partial length with the rod cap 11 inserted into the hollow core 17 of rod 12. The lip 13 of rod cap 11 extends over the hollow rod wall end 21' of the rod 12. Aperture 18 is located in the plug portion 15 of the rod cap 11. Hidden lines show the plug portion 15 of the rod cap 11 and the remainder of the aperture 18. The capped end 20' is shown.

FIG. 6 is an another exploded view of the right side stair bracket 30; the left side stair bracket 31 is a mirror image thereof. Also shown is the finial 14, and a partial section of the rod 12. The rod 12 shown here is a solid core 19 type rod 12 with the aperture 18 in the end 20 of the rod 12. The other end of the rod 12 and the finial 14 are a mirror image thereof. The top portion 32 of the bracket 16 shows in hidden line the aperture 54 in the outside end wall 46, the projections 36, 38, the wall thickness 55 of the inside end wall 48 and the wall thickness 53 of the outside end wall 46. The hidden lines in the bottom portion 34 show the structure of the inside end wall 60 extending from the base portion 58 and the structure of the travel stop 62 extending upwardly from the base 58.

FIG. 7 is a cross section view, taken along section line 7—7 of FIG. 3, of the right side stair bracket 30 of FIG. 2, as mounted on the rod 12 in FIG. 1. The left side stair bracket 31 is a mirror image thereof. The rod 12 is shown in partial view, with hidden lines showing the rod wall 21. The rod wall end 21' is shown. The hidden lines show the edges of the projection 36 and the channel 40, as well as fastener 72 and edges of rod receiving portion 66. The cap 11 and finial 14 are also shown.

Figure 8:
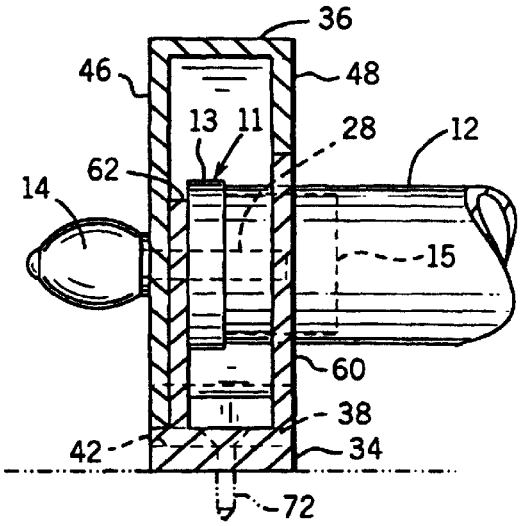
FIG. 8 is a cross section, taken along section line 8—8 of FIG. 3, of the bracket of FIG. 2, as mounted in FIG. 1; the left side stair bracket being a mirror image thereof.

FIG. 8 is a cross section view, taken along section line 8—8 of FIG. 3, of the right side stair bracket 30 of FIG. 2, as mounted in FIG. 1. The left side stair bracket 31 is a mirror image thereof. The rod 12 is shown in partial view. The hidden lines show projection 38 and channel 42, as well as fastener 72, and male fastening member 28 of the finial 14. Portions of cap 11 installed on the rod 12 are also shown. Hidden lines show the plug portion 15 of the cap 11 and the male fastening portion 28 of the finial 14.

The present invention also comprehends the stair rod bracket kit 100 as shown in FIG. 9 and the stair rod kit 200 as best shown in FIG. 10. Because of the ease of use and simplicity of assembly and disassembly of the top portion of the bracket 16, the bottom portion 34 of the bracket 16 may be used with interchangeable top portions 32. The top portions 32 are constructed identically to each other but, differ from each other in bearing decorative indicia 90, or alternatively no indicia, on the front face 44. Where no indicia is applied to the front face 44, a clean unadorned appearance free from any mechanical apertures or marks is achieved. Where indicia 90 is applied, the indicia 90 may be engraved or etched, or otherwise affixed to the front face 44. For example, the top portion 32 is suitably custom engraved to the user/customer's specification and can be changed with other top portions 32 to meet a user/customer's changing interior design schemes. This feature of the present invention permits the user/consumer to change the decorative look of the staircase 24 by replacing only the top portion 32 of the bracket 16. This feature of top portion 32 interchangeability saves the user/customer money because only the top portion 32 of the bracket 16 bearing the indicia 90 desired, needs to be purchased. This feature also protects the staircase 24 since the bottom portion 34 does not need to be replaced, thereby preventing extra holes in the staircase 24 where the bottom portion 34 had been affixed.

A stair rod bracket kit 100 having a plurality of top portions 32 and a single bottom portion 34 is shown in FIG. 9. Where the front face 44 of the top portion bears no indicia, the top portion is numbered 132A; where the front face 44 of the top portion 32 bears indicia 90, the top portion is numbered 132B and 132C. Although only top portions 132A, 132B, 132C are illustrated in FIG. 9, any number of top portions 32 having differing indicia 90 thereon may be used in this kit. For example, a top portion 32 having a stylized letter "Z" indicia is illustrated as 132B; a different indicia 90, for instance, a stylized flower, is illustrated as 132C; other different indicia 90 may be applied to other top portions 32 of the bracket 16. The elements of the top portions 32, (e.g. 132A, 132B, 132C) and for bottom portion 34 are as herein previously shown in FIGS. 1–8 and described throughout for top portion 32 and for bottom portion 34. The only difference in the top portions 132A and 132B(or 132C) is the absence of indicia 90 or the presence of indicia 90 on the front face 44 of the top portion 32 of the bracket 16; or the different indicia 90 on the top portions 132B and 132C on front face 44 of each top portion 32. Fasteners 72 may be included in the kit 100. The kit 100 may be sold to outfit just the right side stair bracket 30, or just the left side stair bracket 31, or the kit 100 may be sold to outfit both the right side stair bracket 30 and the left side stair bracket 31.

FIG. 10 shows a stair rod kit 200 having a plurality of top portions 32 for a left side stair bracket 31, a single left side stair bracket bottom portion 34, a stair carpet retaining rod 12, a plurality of top portions 32 for a right side stair bracket 30, a single right side stair bracket bottom portion 34, and a pair of finials 14. Fasteners 72 may be included in the kit 200. The elements of the rod 12, the pair of finials 14, the bottom portion 34 of the brackets 30, 31, and the top portions 32, (e.g. 132A, 132B, 132C) of the brackets 30, 31 are as shown in FIGS. 1–9 and 11 and as described throughout for the rod 12, the pair of finials 14, the top portion 32 and the bottom portion 34. The interchangeable top bracket portions 32 are as described herein throughout for the stair bracket kit 100. Thus, the top portions 32 of the bracket 16 may have no indicia 90 on the front face 44, as in top portion 132A, or the top portions 32 have indicia 90 on the front face 44, as in top portions 132B and 132C, or different indicia 90 on the front face 44, as in top portions 132B, 132C.

The bracket 16 and the stair rod set 10 are assembled according to the steps of the following method. The carpet runner 22 is arranged on the steps 23 of the staircase 24. A pair of brackets 16 is needed for each side 79, 81 of each step 23 of the staircase 24. One bracket 16 of the pair of brackets 30, 31 to be used on a step 23 is affixed to the step 23 first. For example, the left side stair bracket 31 is fixed to the step 23; alternatively, the right side stair bracket 30 could be affixed to the step 23 first. The bottom portion 34 of the left side stair bracket 31 is positioned on the step 23 to one side of the carpet runner 22 and secured to the step 23 by affixing fasteners 72 through the apertures 70, 68 in the bottom portion 34 of the bracket 31. The top portion 32 of the left side stair bracket 31 is held to the left of the bottom portion 34 and the projections 36, 38 on the top portion 32 are aligned with the complementary shaped channels 40, 42 on the bottom portion 34. Once aligned, the top portion 32 is slid transversely (e.g., longitudinally or sideways) to the right as far as it will travel, this movement positions and engages the top portion 32 in a mating fashion on top of the bottom portion 34 so that the pairs of edges 50, 63 and 52, 64 abut and engage in a mating fashion. (If the right side stair bracket 30 were affixed first, then the top portion is slid transversely to the left as far as it will travel.) When the top portion 32 and the bottom portion 34 are so aligned, the aperture 54 in the outside end side wall 46 and the aperture 78 in the travel stop 62 align; also the rod-receiving portions 56, 66 form the aperture 82 which is suitably dimensioned to receive the rod 12. The male fastening member 28 of the finial 14 is threaded though the apertures 54, 78. One end 20 of rod 12 is placed in the aperture 82 and the rod 12 is moved transversely so that the end 20 of the rod 12 abuts the travel stop 62. The aperture 82 is suitably dimensioned to allow the capped end 20' to pass through the aperture 82. Thus the aperture 82 is suitably dimensioned to allow the lip 13 of the rod cap 11 to pass through the aperture 82 when the hollow core 17 type rod 12 is moved transversely to abut against the travel stop 62. The male fastening portion 28 of the finial 14 is further threaded into the aperture 18 at the end 20 of the rod 12 and fastened therein. When the rod cap 11 is used in the hollow core 17 type rod 12, the male fastening portion 28 of the finial 14 is threaded into the aperture 18 in the plug portion 15 of the rod cap 11. Thus, the male fastening member 28 of the finial 14 fastens the left side stair bracket 31 to the rod 12. The rod 12 in this position extends across the carpet runner 22.

The bottom portion 34 of the right side stair bracket 30 is then positioned on the same step 23 at a suitable distance from the left side stair bracket 31 and to the right of the carpet runner 22. The bottom portion 34 of the right side stair bracket 30 is secured to the step 23 by affixing fasteners 72 through the apertures 68, 70 in the bottom portion 34 of the bracket 30. The other end 20 (the non-fastened end) of the rod 12 is positioned into the rod receiving portion 66 of the inside end wall 60 of the base 58 of the bottom portion 34. The rod 12 is suitably dimensioned so that the unfastened end of rod 12 abuts directly against the travel stop 62. If the rod 12 is of the hollow core type, the lip 13 of the rod cap 11 abuts directly against the travel stop 62. The aperture 18 in the end 20 of the rod 12 (or the aperture 18 in the plug portion 15 of the rod cap 11, if the rod 12 is of the hollow core type) and the aperture 78 in the travel stop 62 are aligned. The top portion 32 of the right side stair bracket 30 is held to the right of the bottom portion 34 and the projections 36, 38 on the top portion 32 are aligned with the respective complementary shaped channels 40, 42 on the bottom portion 34. Once aligned, the top portion 32 is slid transversely (longitudinally or sideways) to the left as far as it will travel, this movement positions and engages the top portion 32 on top of the bottom portion 34 so that the pairs of edges 50, 63 and 52, 64 abut. (If the right side stair bracket 30 is installed first, then the left side stair bracket 31 would be installed next, and the top portion 32 slid into the bottom portion 34 as far right as it will travel.) When the top portion 32 and the bottom portion 34 are so aligned, the aperture 54 in the outside end wall 46 and the aperture 78 in the travel stop 62 align, and the rod receiving portions 56, 66 form the aperture 82 which is suitably dimensioned to receive the rod 12. The male fastening portion 28 of the second finial 14 is threaded though the apertures 54, 78 and fastened into aperture 18. This action fastens the right side stair bracket 30 to the rod 12 and completes the assembly of the stair rod set 10 of the present invention. The method of assembly is repeated for each step 23 of the staircase 24.

To disassemble stair rod set 10 and the brackets 30, 31 for cleaning or polishing, or to change the top portions 32 of the brackets 16, the process is conducted in reverse order. The finials 14 are unfastened and removed. The brackets 30, 31 are slid in an opposite direction to disengage them. The bottom portions 34 of the left side stair bracket 31 and of the right side stair bracket 30 are left fastened to the step 23. The assembly steps are repeated for reassembling the bracket 16 and the stair rod set 10, except for the step of fastening the bottom portion 34 of the bracket 16 to the step 23, which is not needed.

When the stair rod bracket kit 100 or the stair rod kit 200 are used, the steps in the method of assembly is identical to that discussed above, except that prior to the method steps of positioning the top portion 32 on the lower portion 34 of the respective bracket 16, one of a plurality of top portions 32 is selected by the user/consumer to be used. Likewise the method of disassembly is as previously stated herein throughout.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

What is claimed is:

1. A stair rod bracket for use in a stair rod set having a stair carpet retaining rod and a finial with a male fastening member thereon, said bracket comprising:

a top portion having a rod-receiving portion and an end wall, said end wall having an aperture therein for accepting the male fastening portion of the finial;

a bottom portion having a rod-receiving portion;

a plurality of projections and complementary shaped channels for receiving said projections disposed on said top portion and said bottom portion, for transverse engagement of said top portion with said bottom portion; and a travel stop on said bottom portion for stopping the lateral travel of said top portion with respect to said bottom portion and for stopping lateral travel of the carpet retaining rod.

2. The stair bracket of claim 1, wherein said plurality of projections are disposed on said top portion and said complementary channels are disposed on said bottom portion of said bracket.

3. The stair bracket of claim 2, wherein said plurality of projections are dove-tailed projections and said plurality of channels are correspondingly shaped dove-tailed channels.

4. The stair rod bracket of claim 1, wherein said travel stop is a plate extending from said bottom portion and spaced from said rod-receiving portion of said bottom portion, said travel stop having an aperture therein dimensioned to accept the male fastening portion of the finial, and dimensioned to pass through said rod-receiving portion of said top portion of said bracket when said top portion of said bracket is transversely engaged with said bottom portion of said bracket.

5. A stair rod set comprising:

a stair carpet retaining rod;

a pair of finials, each said finial having a male fastening portion; and a pair of stair brackets, each said bracket having a top portion;

a bottom portion;

a plurality of projections and complementary shaped channels for receiving said projections disposed on said top portion and said bottom portion, for transverse engagement of said top portion with said bottom portion; and a travel stop on said bottom portion for stopping the lateral travel of said top portion with respect to said bottom portion and for stopping lateral travel of said rod;

wherein each said top portion and said bottom portion has rod-receiving portions dimensioned to accept a portion of said rod, and wherein said top portion has an end wall having an aperture therein for accepting said male fastening portion of one said finial.

6. The stair rod set of claim 5, wherein said plurality of projections are disposed on said top portion and said complementary channels are disposed on said bottom portion of said bracket.

7. The stair rod set of claim 6 wherein said plurality of projections are dove-tailed projections and said plurality of channels are correspondingly shaped dove-tailed channels.

8. The stair rod set of claim 5, wherein said travel stop is a plate extending from said bottom portion and spaced from said rod receiving portion of said bottom portion, said travel stop having an aperture therein dimensioned to accept said male fastening portion of one said finial and dimensioned to pass through said rod receiving portion of said top portion of the bracket when said top portion of said bracket is transversely engaged with said bottom portion of said bracket.

9. A stair rod bracket kit for use in a stair rod set having a stair carpet retaining rod and a finial with a male fastening portion thereon, said stair rod bracket kit comprising:

(a) a plurality of top portions of a bracket, each said top portion having a face and two end walls extending from said face, one said end wall having an aperture therein for accepting the male fastening portion of the finial, the other said end wall having a rod-receiving portion for accepting a portion of the rod;

(b) a single bottom portion of a bracket for use with any one of said plurality of top portions, said bottom portion having a base with an end wall having a rod-receiving portion, for accepting a portion of the rod, extending from said base and an interior plate extending from said base, said end wall spaced from said interior plate, said interior plate stopping the lateral travel of said top portion with respect to said bottom portion and for stopping lateral travel of the rod; and (c) a plurality of projections and complementary shaped channels for receiving said projections disposed on said top portion and said bottom portion for transverse engagement of said top portion with said bottom portion;

wherein said plurality of top portions differ from one another in the absence or presence of indicia applied to said face or in the presence of differing indicia applied to said face.

10. The stair rod bracket kit of claim 9, wherein said plurality of projections are disposed on said top portion and said complementary channels are disposed on said bottom portion of said bracket.

11. The stair rod bracket kit of claim 10, wherein said plurality of projections are dove-tailed projections and said plurality of channels are correspondingly shaped dove-tailed channels.

12. A stair rod set kit comprising:

(a) a stair carpet retaining rod;

(b) a pair of finials, each said finial having a male fastening portion; and (c) a pair of stair brackets, each said bracket of said pair including (i) a plurality of top portions, each said top portion having a face and two end walls extending from said face, one said end wall having an aperture therein for accepting said male fastening portion of said finial, the other said end wall having a rod-receiving portion for accepting a portion of said rod;

(ii) a single bottom portion for use with any one of said plurality of top portions, said bottom portion having a base with an end wall having a rod-receiving portion, for accepting a portion of said rod, extending from said base and an interior plate extending from said base, said end wall spaced from said interior plate, said interior plate stopping the lateral travel of said top portion with respect to said bottom portion and for stopping lateral travel of said rod; and (iii) a plurality of projections and complementary shaped channels for receiving said projections disposed on said top portion and said bottom portion, for transverse engagement of said top portion with said bottom portion;

wherein said plurality of top portions differ from one another in the absence or presence of indicia applied to said face or in the presence of differing indicia applied to said face.

13. The stair rod set kit of claim 12, wherein said plurality of projections are disposed on said top portion and said complementary channels are disposed on said bottom portion of said stair rod brackets.

14. The stair rod set kit of claim 13, wherein said plurality of projections are dove-tailed projections and said plurality of channels are correspondingly shaped dove-tailed channels.

* * * * *